United States Patent [19]

Rusk et al.

[11] 3,986,548

[45] Oct. 19, 1976

[54] GUIDE PIN AND BUSHING ASSEMBLY FOR FLASK, PATTERNS, AND THE LIKE

[75] Inventors: Gerald R. Rusk, Maumee, Ohio; Robert E. Koch, Ottawa Lake, Mich.

[73] Assignee: The Freeman Supply Company, Toledo, Ohio

[22] Filed: July 7, 1975

[21] Appl. No.: 593,261

Related U.S. Application Data

[60] Continuation of Ser. No. 366,506, June 4, 1973, abandoned, which is a division of Ser. No. 159,550, June 2, 1971, Pat. No. 3,776,299, which is a division of Ser. No. 857,819, Sept. 15, 1969, Pat. No. 3,612,161.

[52] U.S. Cl. ..... 164/387

[51] Int. Cl.[2] ..... B22C 21/10

[58] Field of Search ..... 164/385, 386, 387, 388, 164/390; 403/292, 296, 360

[56] References Cited

UNITED STATES PATENTS

| | | | |
|---|---|---|---|
| 2,499,146 | 2/1950 | Kindt | 403/345 X |
| 2,677,160 | 5/1954 | Peterson | 403/360 |
| 3,472,312 | 10/1969 | Rusk | 164/387 |

*Primary Examiner*—Francis S. Husar
*Assistant Examiner*—John E. Roethel
*Attorney, Agent, or Firm*—William P. Hickey

[57] ABSTRACT

A two part bushing or guide pin for aligning foundry flasks, hot boxes, and the like comprising: a machinable body portion having external threads for threading into a flask, hot box, etc., and internal threads for receiving either a hardened nonmachinable guide ring or a hardened nonmachinable guide pin.

In the case of the hardened nonmachinable guide ring, the outer surfaces are provided with hardened ground threads adapted to be threaded into the internal threads of the main body portion. Suitable means is provided for locking the ring in angular relationship with the body after it is threaded therein. The construction permits the main body portion of the bushing to be firmly seated and locked in a flask, etc., following which the hardened ring can be rotated within the main body portion until its surfaces are accurately angularly positioned relative to the flask, and the ring then locked to the bushing. The locking means may comprise an opening through the sidewalls of the ring for receiving a staking tool for deforming the internal threads of the main body portion. Alternatively, a longitudinally extending hemicylindrical groove may be provided in the periphery of the hardened ring, and the adjacent portion of the body drilled, to receive a soft metal locking pin.

In the case of the guide pin, it is provided with a ground and hardened guide pin insert having external ground threads adapted to be inserted into the softer machinable body portion. The guide pin insert may include the hemicylindrical groove for locking it to the machinable body portion.

4 Claims, 11 Drawing Figures

GUIDE PIN AND BUSHING ASSEMBLY FOR FLASK, PATTERNS, AND THE LIKE

This application is a continuation of Ser. No. 366,506, filed June 4, 1973, now abandoned; which in turn was a division of Ser. No. 159,550, filed June 2, 1971, now U.S. Pat. No. 3,776,299; which in turn was a division of Ser. No. 857,819, filed Sept. 15, 1969, now U.S. Pat. No. 3,612,161.

BACKGROUND OF THE INVENTION

The foundry art has three general types of processes for producing castings. In one type of process, the half sections of a pattern are accurately secured to flat surfaces and usually to the opposite sides of a flat pattern plate. A foundry flask that is a rectangularly shaped box having open top and bottom sides is accurately positioned against one side of the pattern plate, and a foundry sand containing a clay or other type of binder is tamped around the pattern section. The flask and pattern are inverted and the pattern plate lifted from the top of the flask to expose the surface of the sand having a cavity therein conforming to the pattern section. Thereafter the sand is dried and its binder hardened and the process is repeated for the other half section of the pattern. The two flasks having the mold cavities therein, are accurately booked or aligned, as will later be explained, to provide the total cavity into which molten metal is poured.

In another type of process which makes what are called "shell molds", the two half pattern sections are made of metal and each is accurately installed upon the flat surface of a metal plate or plates. This plate is made to be a part of the pattern heating box of a large machine called a shell mold forming machine. Such a machine also includes a rectangularly shaped sand tank which holds resin coated sand and which must be accurately positioned on top of the pattern heating box containing the pattern and pattern plate. The pattern heating box containing the pattern section is placed on top of the sand tank, and the sand tank and heating box inverted so that binder coated sand in the sand tank falls down on top of the heating box and pattern section. The box and pattern section are heated so that the resin coated sand adjacent the heated surfaces of the pattern section and box become hardened to a depth of approximately one half inch to provide a "shell" of sand and cured resin. The said tank and heating box are inverted to allow the loose sand to fall back down into the sand tank, and the "shell" containing an accurate impression of the pattern section is removed from the pattern plate. This process is repeated with respect to the pattern plate containing the other half section of the pattern, and the two "shells" are thereafter cemented together to form the total cavity that is to be filled with the molten metal. The booked and cemented "shells" are embedded in sand or metal shot to a sufficient depth to withstand the hydrostatic head of the molten metal.

The third type of process commonly used is called the "hot box process" which is similar to the "shell molding" process but differs principally therefrom in that the box surrounding the pattern is heated, and the resin coated sand is introduced into the heated box from a separate container. In the "hot box process", the resin surrounding the pattern is cured in depth to form a finished cured mold.

In the processes above described, it is essential that the two half sections of the pattern be accurately located on pattern plates, and that these pattern plates be accurately located relative to the flasks, hot boxes, etc. in order that the molded sand will have side or other reference surfaces which can be easily aligned with respect to each other.

In the first described process, it is necessary to accurately register the pattern plate and flasks and thereafter accurately register the flasks containing the half mold sections. In the second or third processes above described, it is necessary to accurately position or register the pattern plate with the sand tank, or hot box, used to form the molds. In any of the processes given above, the means which has been found most convenient for performing the necessary alignment, comprises the use of a plurality of cooperating pins and bushings, the pins of which are received in accurate internal guide surfaces of the bushings. In those instances where large castings are to be made, it is relatively impossible to obtain equal thermal expansion of all mated metal parts of the equipment when heated to cure the resin of the coated sand. The means customarily used to accommodate the difference in thermal expansion is the utilization of at least one bushing containing a round opening which tightly engages the pin, while the bushings which are positioned remotely therefrom, contain elongated openings having internal parallel guide surfaces that are oriented in the direction of thermal expansion. The elongated bushings of the prior art have been of two general types: the first of which has external threads which extend through the flask, or the hot box, as the case may be, and which are secured in place by a nut on the back side of the member in which it is installed. Whenever one of these bushings becomes damaged, or the guide pin becomes broken, it is necessary to take the flask, the shell molding machine, or the hot box machine, as the case may be, out of operation and drill or "fish out" the broken pin or bushing.

The most commonly used type of bushing has been one with plain cylindrical side surfaces, which surfaces are provided with an interference fit relative to the receiving openings which are made in the flasks, pattern heating boxes, hot boxes, etc. in which they are to be installed. The bushings are installed with its internal oblong opening "eye-balled" in the direction of thermal expansion. The bushing is thereafter, pressed into the receiving opening. Some rotation of the bushing usually always takes place while it is being pressed down into the receiving opening, so that the installed bushing is not properly aligned, and undue wear of the guide pins and bushings occurs.

A further difficulty with the prior art guide bushings and pins has occurred by reason of the continuing heating up and cooling down of the equipment in which the pins and bushings are installed. If this heating up and cooling down is not accompanied by condensation, the bushing may eventually loosen up in its receiving opening. In most instances, however, some condensation is present, and in this instance, the bushings and pins, and particularly the pressed in bushings and pins become frozen into the equipment into which they are installed, particularly where the equipment is cast aluminum. The removal of the bushings or pins is made difficult because they are hardened to withstand the abrasion of the foundry sand and are, substantially, nonmachinable. In many instances the equipment must be removed to a machine shop where the best available equipment and techniques are available for "fishing" the bushing out of the equipment.

Pins and bushings of the press fit type are usually made in an original equipment size, plus at least two oversizes. Each oversize pin or bushing is used to replace the next smaller size pin or bushing. Not only is the removal of the pins and bushings difficult and costly, but the warehousing, selecting and installation of the replacement items is expensive.

An object of the present invention, therefore, is the provision of a new and improved bushing the guide surfaces of which can be more accurately positioned in the equipment in which the bushing is installed than can the prior art bushings.

A further object of the present invention is the provision of a new and improved guide bushing which can be easily removed and new guide surfaces installed without the removal of the equipment in which the bushing is installed to machine shops, etc.

Further objects and advantages will become apparent to those skilled in the art from the drawings and following description of the preferred embodiments.

DESCRIPTION OF THE PREFERRED EMBODIMENTS

Figures 1, 2, 3, 4, 5, 6, 7:
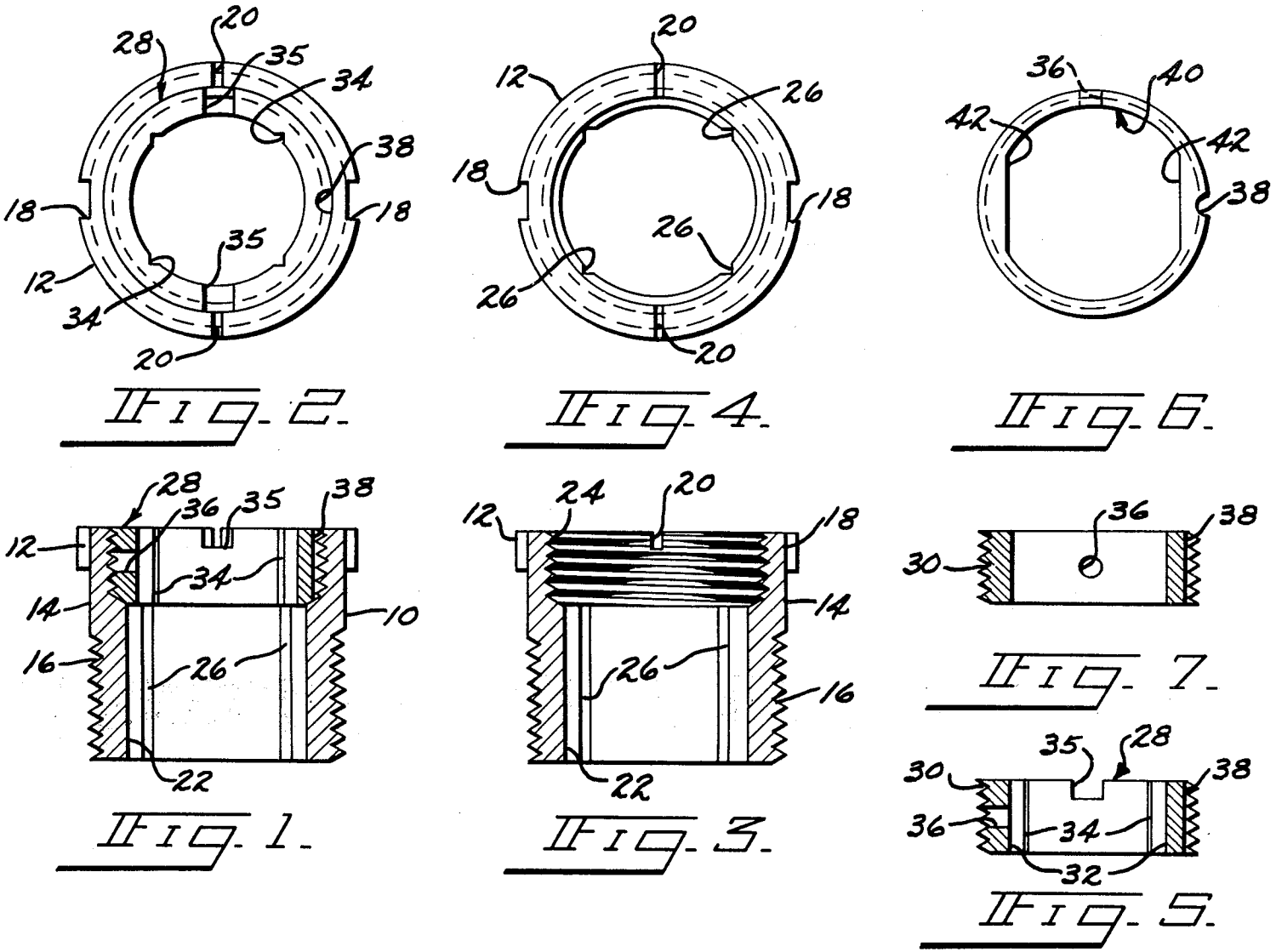
FIG. 1 is a sectional view of a cylindrical bushing assembly of the present invention.
FIG. 2 is a plan view of the bushing assembly shown in FIG. 1.
FIG. 3 is a sectional view of the body portion of the bushing assembly shown in FIGS. 1 and 2.
FIG. 4 is a plan view of the body section shown in FIG. 3.
FIG. 5 is a sectional view of the hardened ring shown in the assembly of FIGS. 1 and 2.
FIG. 6 is a plan view of a hardened ring having a cylindrical internal guide surface.
FIG. 7 is a sectional view of the hardened ring shown in FIG. 6.

The guide pins and bushings of the present invention, whether they contain a pin, an internal cylindrical guide surface, or an oblong opening having parallel guide surfaces, are formed in two pieces. The bushing comprises an outer body portion 10 having an external flange 12 at its upper end, and a cylindrical centering surface 14 immediately beneath the flange. The lower end of the body portion is provided with external threads 16 by means of which the body member can be threaded into and thereby secured to the flask, hot box, or other member which is to be accurately positioned relative to another member. The body member 10 is provided with suitable wrench engaging surfaces, as for example a pair of rectangular grooves 18 that are cut through opposite sides of the flange 12 and which are adapted to receive suitable designed tangs of a wrench. Body member 10 may further include transverse slots 20 that are milled or otherwise cut across the top surface of the flange 12 to a suitable depth for receiving a flat blade of a wrench. In some instances, the body 10 may be provided with both the grooves and the slots 20.

The body member 10 has a longitudinally extending opening 22 therethrough, the upper end of which is suitably threaded as at 24. The body member 10 preferably also includes four longitudinally extending grooves 26, in the side walls of the opening 22 and which are shaped and positioned to receive the corners of a square bar when slid longitudinally into the opening 22. Where the I.D. of the threads 24 is the same as that of the side walls 22, the grooves 26 will extend through portions of the threads 24. The grooves 26 are preferably broached or otherwise formed in the side walls of the opening 22 prior to the time that the threads 24 are made. Grooves 26 may not be necessary in all instances, but are to be preferred as providing additional means for applying torque to a body 10 which has become frozen in an opening of the equipment in which it is installed. The side walls of the opening 22 can be broached or otherwise conveniently made concentric with the cylindrical surface 14, and the structure so far described is made of a machinable material and is not hardened to a nonmachinable condition.

The bushing of the present invention also includes a hardened ring 28 having external ground threads 30 or which are otherwise accurately formed for close engagement with the threads 24. The ring 28 has a longitudinally extending cylinrical opening 32 therethrough, and suitable wrench engaging surfaces for threading the ring 28 into and out of the upper end of the body member 10. In the preferred embodiment of ring 28 shown in the drawings, the side walls of the opening 32 are provided with four longitudinally extending grooves 34 which are shaped and positioned to receive the corner edges of a square shaped bar when inserted into the opening 32. Alternatively wrench engaging recesses 35 through the ring may be provided for both the grooves 34 and recesses 35 may be provided. The opening 32 and grooves 34 and recesses 35 are preferably formed when the ring 28 is in a machinable condition and prior to hardening of the ring. The surface of the opening 32 may therefter be ground slightly as may be necessary to insure its accuracy after hardening, and this surface then used for centering during the griding operation. Where other types of wrench engaging surfaces are used, as for example slots across the top face of the ring, these surfaces are preferably also formed before hardening. The ring 28 includes a locking provision which may be the recesses 35, or in the preferred embodiment, comprises one or more openings or recesses 36 which extend through the side walls of the ring 28 between the side walls of the opening 32 and the threads 30 and through which a staking tool can be inserted to deform the threads 24. As another means of locking the ring 28 into the bushing body 10, the external surface of the ring 28 may be provided with a hemicylindrical groove 38 formed preferably before hardening. When the ring 28 is angularly positioned, and it is desired to lock it into the body 10, the groove 38 can be used to center a drill for machining away portions of a body 10, including portions of the thread 24 to complete a cylindrical opening for the reception of a steel dowel pin or the like.

The ring structure so far described may be used for guide pins having cylindrical guide openings 32. In those instances where the guide ring is to have an oblong opening 40 (see FIGS. 6 and 7) for accommodating thermal expansion of the member whose guide pin it is to receive, a similar structure will be used excepting that the internal opening 40 of the ring will be oblong as shown in FIG. 6. This oblong opening 40 can be made by first drilling an opening, smaller than required, and thereafter broaching the opening into the oblong configuration 40. Rings containing the oblong opening 40 will, of course, have the external threads 30, a recess 35 or 36, or groove 38, or both. Bushings having the oblong opening 40 are also preferably machined before hardening. The oblong opening 40 need not be exactly as shown in FIG. 6, so long as it has parallel side portions 42 accurately ground or otherwise machined to engage opposite sides of a pin of predetermined diameter. These bushing inserts having an oblong opening may be threaded into the body portion 10 by a wrench having an oblong surface generally corresponding to the oblong opening 40.

Figure 8:
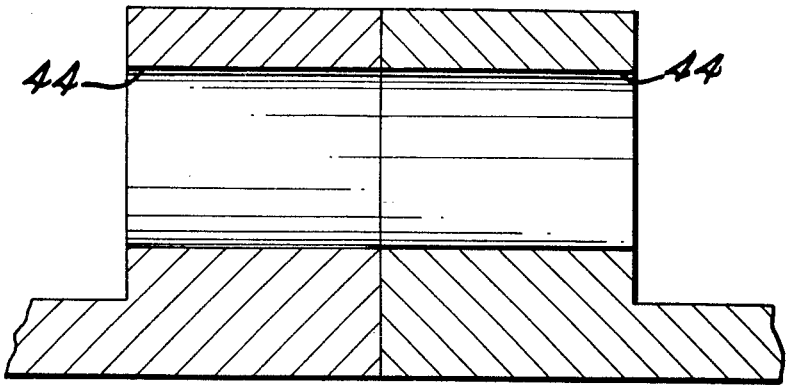
FIG. 8 depicts a first stage of the preferred method of accurately installing the guide bushings of the present invention relative to their cooperating guide pins.
Figure 9:
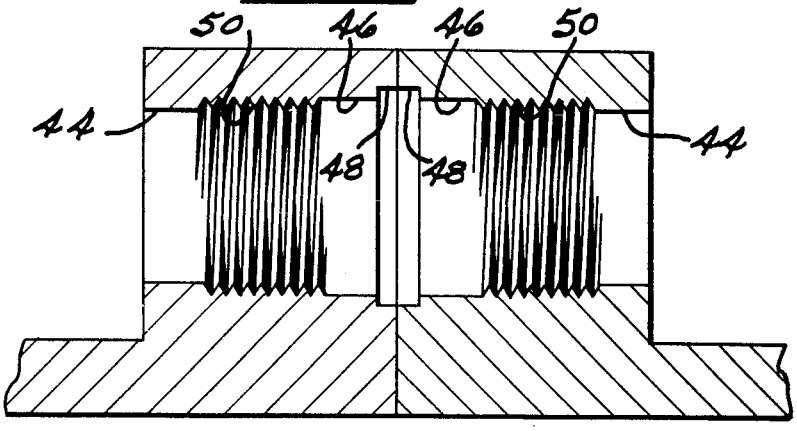
FIG. 9 depicts a second stage in the installation of the pins and bushings of the present invention.

In the preferred method of installation and use of the bushings of the present invention, the flask, hot box or other member in which the bushing is to be installed is superimposed on a pattern plate and/or flask, hot box or other member to which it is to be accurately aligned. A longitudinal opening 44 is drilled through both members when accurately aligned as shown in FIG. 8. The opening 44 is either accurately drilled or otherwise machined to have a diameter either equal to or slightly less than the root diameter of the threads 16 of the body portion 10. Thereafter the member in which the bushing is to be installed, is separated from the booked member, and a counterbore 46 is made having a depth greater than the distance between the end of the cylindrical section 14 and top of the flange 12. A large counterbore 48 is then formed to receive the flange 12, and the threads 50 are tapped into or otherwise formed in the opening 44 beneath the counterbore 46. It will be seen that a body member 10 with or without the ring 28 can now be threaded into the opening so far provided. Body member 10 may be threaded into position using any of the wrench receiving surfaces 18, 20 or 26. The opening 44 in the member to be fitted with a pin is then similarly bored and counterbored, as shown in FIG. 9.

Figure 10:
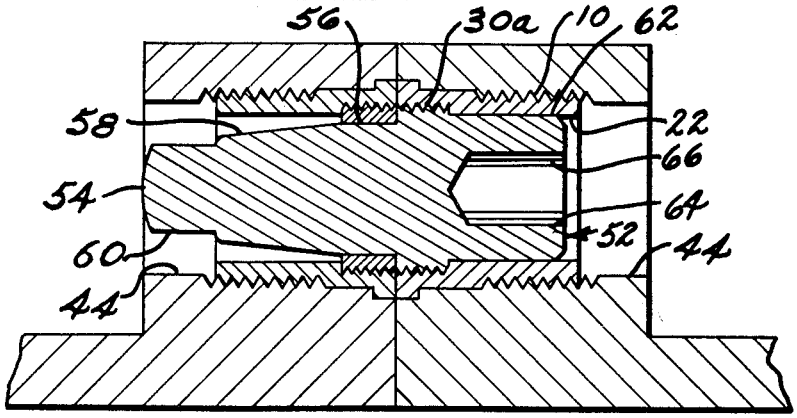
FIG. 10 is a sectional view through a guide pin and bushing of the present invention, and depicts the final stage of the installation of the bushings and pins of the present invention.
Figure 11:
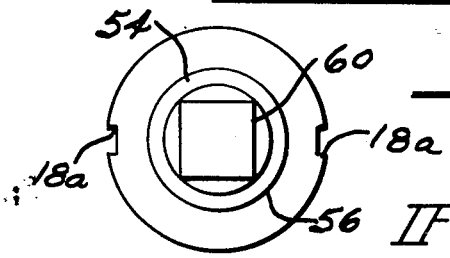
FIG. 11 is a plan view of the guide pin shown in FIG. 10.

It is a further feature of the invention, that guide pins be made in two pieces comprising a machinable body portion 10, and a hardened pin insert 52 having external threads 30*a* that are identically shaped with those of the bushings. Those portions of the pin insert 52 which correspond in shape to those of the guide bushing rings are designated by a like reference numeral characterized further in that a suffix *a* is affixed thereto. A properly shaped pin for use in the present invention is shown in FIGS. 10 and 11. The pin insert 52 has a projection 54 having a cylindrically shaped guide surface 56 having a sliding fit with respect to the opening 32 or surfaces 42, as the case may be. A tapered guide surface 58 projects from the cylindrical surface 56, and the end of the projection 54 is polygonal shaped as at 60 to receive a wrench. The pin insert 52 preferably also has a pilot or guide portion 62 having cylindrical side walls that have a sliding fit with respect to the side walls of the opening 22 of the body 10. The guide portion 62 has an axially extending opening 64 in the bottom end thereof for receiving a tool which will permit the pin 52 to be unthreaded from the body 10 when the projection 54 is broken or damaged. In the preferred embodiment, the sidewalls of the opening 64 are provided with four equally spaced grooves 66 adapted to receive the corners of a square bar. Alternatively, the opening 64 may be given a hexagonal shape, or may be threaded so that torque can be provided to the pin 52. The bushing 10 which receives the pin insert 52 need not be identically shaped with that for receiving the ring 28, and numerous changes could be made thereto, as for example by interchanging the guide portion 62 and threaded portion 30*a*, or by providing a seating shoulder for limiting threaded insertion of the pin in the body. The wrench receiving opening 64 can also be used to advantage in conventional one piece guide pins that do not include the removable body 10.

The opening 32 of the ring shown in FIGS. 1 and 2 has a diameter equal to the spacing of the surfaces 42. After the body portion 10 of the bushings of the present invention are threaded into the openings 44 to bring their flange portions 12 into firm tight engagement with the bottom of the counterbore 48, the hardened ring 28 is threaded into the threads 24 of the body 10 until its top surface is flush or slightly below the top surface of the flange 12. In those instances where the ring 28 contains a cylindrical opening 32, the installation is completed by simply locking it in position relative to the body member. This may be accomplished by placing a staking tool through the opening 36 of the bushing when provided and deforming the portion of the threads 24 that are exposed by the opening 36. In those instances when the ring or in insert 52 is provided with the hemicylindrically shaped groove 38, a drill of the proper diameter is centered on the body 10 using the surface 38 as a guide, and the body member 10 drilled to a suitable depth. Thereafter, a soft metal pin, not shown, is placed in the opening thus provided to lock the ring 28 or pin against rotation.

In those instances where the bushing 10 is to be provided with a ring having an oblong opening 40 therein, the ring is threaded into the threads 50 until its top surface is flush or slightly below the top surface of the flange 12. A tool having a projection which tightly engages the surfaces 42 is placed into the opening 40 and the tool rotated until the guide surfaces 42 exactly correspond with the direction of thermal expansion. The tool is removed, and the ring is locked into position, either by staking the threads 24 through a recess 35 or 36, or by drilling the body 10 adjacent the groove 38 and placing a pin therein, as previously described.

In the most preferred embodiment, the guide pin inserts 52 have pin portions 54 thereon which are harder than are the guide rings, so that sliding of the pins in the guide bushings produce wear of the ring portions rather than the pin portions 54. After the guide surfaces 32 or 42, as the case may be, of the bushing have become worn, a wrench is placed into the wrench receiving surfaces of the ring and the ring is rotated relative to the body member 10. In the case of an oblong opening 40, the wrench may have a shape corresponding to the shape of the oblong opening 40, and in the case of a cylindrical opening, a square bar may be inserted into the grooves 34 or wrench openings machined into the upper surface of the ring 28 as previously described. Rotation of the hardened rings will machine out the staked section of the threads 24 where this has been the means used to lock the ring in place. Where a soft pin has been used to engage the surface of the groove 38, the hardened ring will shear off the softened pin used to lock the ring in place. After the ring is removed, a new ring having unworn surfaces can be inserted and locked in place in the same manner previously described. If it is desired to remove the bushing body 10 after the ring is removed, a wrench can be caused to engage one or more of the wrench engaging surfaces 18, 20, 26, 42 or 60, and the relatively soft or machinable body can be removed. If for any reason it is not possible to unthread the body member 10, it is possible to machine out the body member 10, since all of the hardened portions were removed with the ring or pin insert. It will rarely be necessary to remove the body member 10, however, even where the structures in which the body member 10 is frozen in an aluminum casting since all of the guiding surfaces are replaceable inserts. The body members and the inserts are preferably made of steel, and by using a "never seize" compound between the insert and body, they will almost always separate.

It will now be seen that the objects heretofore enumerated as well as others have been accomplished, and that there has been provided bushings and pins having standard dimensions which can be interchanged. It is further seen that the bushings of the present invention can have their guide surfaces accurately adjusted, and that these hardened guide surfaces can be easily and quickly removed and be replaced without damage to the main body portion of the bushing or to the member in which the bushing is installed. Replacement of the hardened guide surfaces can be done from the front face of a shell molding machine, or a hot box forming machine, without cooling or disassembling the machine. It will further be seen that bushings of different press fit diameters need not be provided, and that tools of standard diameter can be used for the formation of all openings in the equipment in which the pins and bushings are to be installed.

While the invention has been described in considerable detail, we do not wish to be limited to the particular embodiments shown and described, and it is our intention to cover hereby all novel adaptations, modifications and arrangements thereof which come within the practice of those skilled in the art to which the invention relates.

We claim:

1. A guide pin assembly comprising: an annular machinable body having an upper external flange portion, an external cylindrical guide portion beneath said flange portion and an external threaded portion beneath said guide portion, said annular body having an axially extending opening therethrough with internal threads at its upper end and an internal cylindrical guide portion beneath said internal threads, a hardened pin having a lower portion supported by said annular body and a projecting upper portion, said lower portion having external threads that are threaded into said internal threads of said annular body and a lower portion slidingly engaged by said internal cylindrical guide portion of said annular body, said projecting upper portion of said hardened pin having a cylindrical guide surface projecting out of said annular body, and a tapered guide portion outwardly of said cylindrical guide surface and at least the projecting upper portion of said hardened pin being hardened to a nonmachinable, sand abrasion resistant condition.

2. The guide pin assembly of claim 1 wherein the lower end of said hardened pin has an axially extending opening therein, said opening having wrench engagement surfaces therein and said opening being blind to protect said wrench engagement surfaces from abrasion by sand.

3. The guide pin assembly of claim 2 wherein the upper end of said hardened pin has a polygonal cross section to provide wrench abutment surfaces.

4. A readily replaceable, hardened, nonmachinable guide element for retention in a softer machinable ferrule having a lower externally threaded end for threading into a metal support structure, said guide element having: an externally threaded flange intermediate its upper and lower end portions for threaded engagement with the ferrule, said lower end portion being unthreaded and comprising a cylindrical centering section of a diameter less than that of said threaded flange for centering said guide element in the ferrule, said cylindrical section having an axially extending opening having polygonal shaped wrench abutting sidewalls opening outwardly of its bottom end surface, said upper end portion comprising a cylindrical guide surface having a diameter less than that of said threaded flange and which is positioned immediately above said threaded flange, said upper end portion also having a tapered section upwardly of its cylindrical guide section, and a polygonal shaped wrench engaging section upwardly of said tapered guide section, and whereby torque can be applied from said wrench engaging section directly to said threaded flange without first passing an area that is adapted to be jammed into the body in which the guide element is received and torque can also be applied to said cylindrical centering section without first passing through the section adapted to be threaded into the body in which the guide element is received.

* * * * *